US005110286A

United States Patent [19]

Gaysert et al.

[11] Patent Number: 5,110,286

[45] Date of Patent: May 5, 1992

[54] DEVICE FOR PREHEATING FUEL FOR AN ULTRASONIC ATOMIZER FOR HEATERS

[75] Inventors: Herr G. Gaysert, Esslingen; Herr D. Götz, Kirchheim, both of Fed. Rep. of Germany

[73] Assignee: J. Eberspächer, Esslingen, Fed. Rep. of Germany

[21] Appl. No.: 534,288

[22] Filed: Jun. 7, 1990

[30] Foreign Application Priority Data

Jun. 8, 1989 [DE] Fed. Rep. of Germany ..... 3918663

[51] Int. Cl.[5] ..... F23D 11/44

[52] U.S. Cl. ..... 431/208; 431/1; 431/353; 239/102.2; 239/135

[58] Field of Search ..... 431/1, 240, 208, 353, 431/354; 239/135, 102.1, 102.2

[56] References Cited

U.S. PATENT DOCUMENTS 3,227,201 1/1966 Pokorny ..... 431/353
3,477,644 11/1969 Bablouzian et al. ..... 431/208
4,371,778 2/1983 Meixner et al. ..... 431/208
4,477,715 10/1984 Bell et al. ..... 431/208
4,877,395 10/1989 Schbach et al. ..... 431/208

FOREIGN PATENT DOCUMENTS 3622697 11/1985 Fed. Rep. of Germany ..... 431/1

*Primary Examiner*—James C. Yeung
*Attorney, Agent, or Firm*—McGlew & Tuttle

[57] ABSTRACT

A device for preheating fuel for an ultrasonic atomizer (11) is shown, in which the fuel for an engine-independent heater operated with liquid fuel is atomized. The heating element (20), which preferably consists of a PTC element, is arranged in physical proximity to the ultrasonic atomizer (11) and outside the fuel feed line (17) so that it is switched off as soon as a sufficient amount of heat is generated by the combustion chamber (3), so that the fuel is adequately atomized on the atomizer plate. Reliable possibility of start at low temperatures (down to cA. −40° C.) is thus achieved at low power consumption in the start-up range.

14 Claims, 4 Drawing Sheets

DEVICE FOR PREHEATING FUEL FOR AN ULTRASONIC ATOMIZER FOR HEATERS

FIELD AND BACKGROUND OF THE INVENTION

The present invention pertains generally heaters used for the engine-independent heating of motor vehicles and for preheating engines and more particulary to a device for preheating fuel for an ultrasonic atomizer in a heater operated with liquid fuel, which includes a combustion chamber with a heat exchanger adjoining it and an ignition zone, into which the igniting device extends, as well as a burner head with means for supplying fuel and combustion air, wherein the ultrasonic atomizer has a central longitudinal bore for the fuel, which bore communicates with a radial bore for the fuel supply, and the ultrasonic atomizer is arranged within the burner housing in its longitudinal axis in an atomizer flange provided with an offset longitudinal through bore.

A device of this class is known from U.S. Pat. No. 4,732,322 (corresponding to West German Patent No. DE-PS 35,22,697). The device described in this patent is also used for the engine-independent heating of motor vehicles, construction equipment, and boats, as well as for preheating the engines of such units. Such vehicle heaters must be compact, because only very limited space is available for installation. Furthermore, they should have a low power consumption, because they are supplied with electricity from the vehicle battery, which has a particularly low power delivery capacity at very low temperatures, i.e., precisely when a particularly great need arises for the engine-independent heating of the vehicle's interior and, if desired, for preheating the engine.

Prior-art heaters with a heating capacity of circa 10 kW have a fuel throughput of circa 1.3 L diesel fuel per hour. In steady-state operation, i.e., under a hot running condition of the unit, 2 W electrical effective power is required for the ultrasonic atomization, including a safety reserve. This is generated by an ultrasound generator in an oscillator circuit and is fed to the ultrasonic atomizer. At cold start under extreme conditions, e.g., −40° C., for which such heaters are designed in particular, the electrical power consumption increases 5–10-fold as a consequence of the greatly increasing viscosity of the fuel and the resulting increase in vapor deposition on the atomizer plate of the ultrasonic atomizer and the more difficult separation of the fuel mist drops from the fuel film, so that the ultrasound generator must deliver 10–15 W effective power for this state of operation.

For these reasons, the ultrasound generator in the prior-art devices is designed for two power levels, namely, for the cold start phase, e.g., for a power output of 12 W, and for normal operation with a power output of 2 W, level 1 being used only for the start-up range lasting a few minutes at an ambient temperature substantially below 0° C. Once the operating temperature has been reached, so much heat is released by the combustion chamber of the heater by convection and radiation that it is possible to switch over to level 2 with its lower power output.

However, this prior-art device has the disadvantage that the ultrasound generator with its components, the output transmitter and the end-stage transistors, must be designed for the high output of circa 15 W, which leads to a reduced efficiency for the great majority of the operating time and is also expensive. Another disadvantage of this device is the fact that the high electrical effective power causes a great thermal and mechanical load for the ultrasonic atomizer during the cold start phase, which has unfavorable effects on service life and reliability.

SUMMARY AND OBJECTS OF THE INVENTION

To compensate for the fluctuations in viscosity that occurred in heating oil recently, it has become known that a heating element can be arranged in front of the atomizer nozzle in the heating oil feed line in building heating systems equipped with high-pressure atomization burners. This also makes it possible to reduce the lower output limit of this burner, i.e., to atomize less fuel at equal nozzle size. However, such a device is unsuitable for preheating the fuel for heaters intended for vehicles, because in this arrangement of a heating element, which has now become known, this heating element is continuously being bathed by cold fuel, so that the heating element is in operation and continuously consumes electricity. This energy is not available for heating in a vehicle, especially with the engine turned off and the heating on. In contrast, when the heating is on, the temperature of the combustion chamber generates enough heat to preheat the fuel. The basic task of the present invention is to improve a device of this class so that with a slightly more complicated design, it is suitable for power-saving cold start by ensuring fuel atomization in the range of low temperatures (down to ca. −40° C).

This task is accomplished according to the present invention by providing a heating element arranged in the zone of the fuel feed line in the physical proximity to the ultrasonic atomizer and outside the fuel line.

The heat flux from the heating element to the fuel and—after ignition of the heater and heating of the combustion chamber—the heat flux from the combustion chamber to the fuel is adjusted with this device so that the heating element can be turned off or such that it stops by itself after a short operating time of the heater. Therefore, the heating element must not be in excessively close thermal contact with the fuel, because the heating power is not turned off in this case when cold fuel continues to be delivered even when the combustion chamber is already hot, as a consequence of which the power consumption will be high and discharge the battery. It was surprisingly found in this device that external preheating by the heating element can be dispensed with even after the rapid development of the flame in the combustion chamber of the heater and after this flame has been stabilized, because the fuel atomizing plate of the ultrasonic atomizer is heated sufficiently by the flame radiation and convection of the combustion gases, so that the viscosity of the adhering fuel film will be reduced so much that good atomization will be ensured. However, on the other hand, the heat transfer from the heating element to the fuel must be so good that the largest possible percentage of the Joulean heat will be transferred to the fuel and only a small percentage will be lost to the combustion air flowing through the burner head and to the components of the burner.

Therefore, it proved to be advantageous to arrange the heating element on the side facing away from the combustion chamber in a heat-conducting connection with the atomizer flange. The atomizer flange is defined as a component which centrally carries the ultrasonic atomizer and is connected to the burner housing. This atomizer flange may also consist of individual webs. The heating element may be arranged in a projection cast integrally with the atomizer flange and drilled to the size of the heating element, and it may be fixed with a holding clamp. To compensate for tolerances, it is advantageous to introduce a heat-conducting paste between the bore, which does not always need to be round, but may also be oval or angular, depending on the shape of the heating element, and the heating element to ensure good thermal contact. In this device, in which the heating element is made, e.g., of resistance wire, the electrical connections of the heating element are connected to the operating voltage via a relay in the control device of the heater. This relay is turned on during the cold start phase of the heater, and the heat released by the heating element heats the atomizer flange and fuel via the atomizer flange or directly in the case of the fuel feed line arranged on the atomizer flange. At extreme temperatures of between, e.g., −40° C. and −10° C., the fuel delivery can also be turned on with a delay, after a predetermined preheating time, by means of a delay circuit arranged in the control device. In case of sufficient heat transfer from the combustion chamber, the heating element can be turned off as a function of the time or the temperature. However, the heating element may also be designed as a flat element and arranged with a thermally insulating cover on the atomizer flange and clamped there. This manner of fastening is particularly suitable for retrofitting existing heaters with an ultrasonic atomizer.

The use of a semiconductor element connected to the heater control device has proved to be particularly advantageous, wherein the use of a PTC element as a semiconductor element has proved to be particularly preferable in an even more advantageous solution to the task imposed. This solution is particularly advantageous in terms of safety, but it is also less expensive. Another advantage arises from the fact that the ultrasound generator can be designed and optimized for a low effective power, and that no control commands for power selection need be generated in the control device. Since the PTC resistors (cold conductors) are characterized by an abrupt increase in resistance at a material-specific reference temperature, driving via a switching relay can be dispensed with, i.e., the PTC elements are connected as self-regulating heating elements directly to the operating voltage. The PTC heating elements may have cylindrical or plate shape, so that they may be arranged, like the heating elements made of resistance wire, on the pipe in the atomizer flange.

The arrangement of a heat insulation between the atomizer flange carrying the heating element and receiving the fuel supply line and the burner housing has also proved to be advantageous for reducing the heat transfer from the atomizer flange heated by the heating element to the burner housing. This heat insulation acts as a heat choke. A simple ring made of a suitable material is sufficient as a heat insulation for most application, but it is also possible to select a different shape, e.g., an angular profile, in order to thermally separate the metallic burner housing from the metallic atomizer flange as completely as possible.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE PREFERRED EMBODIMENT

Figure 1:
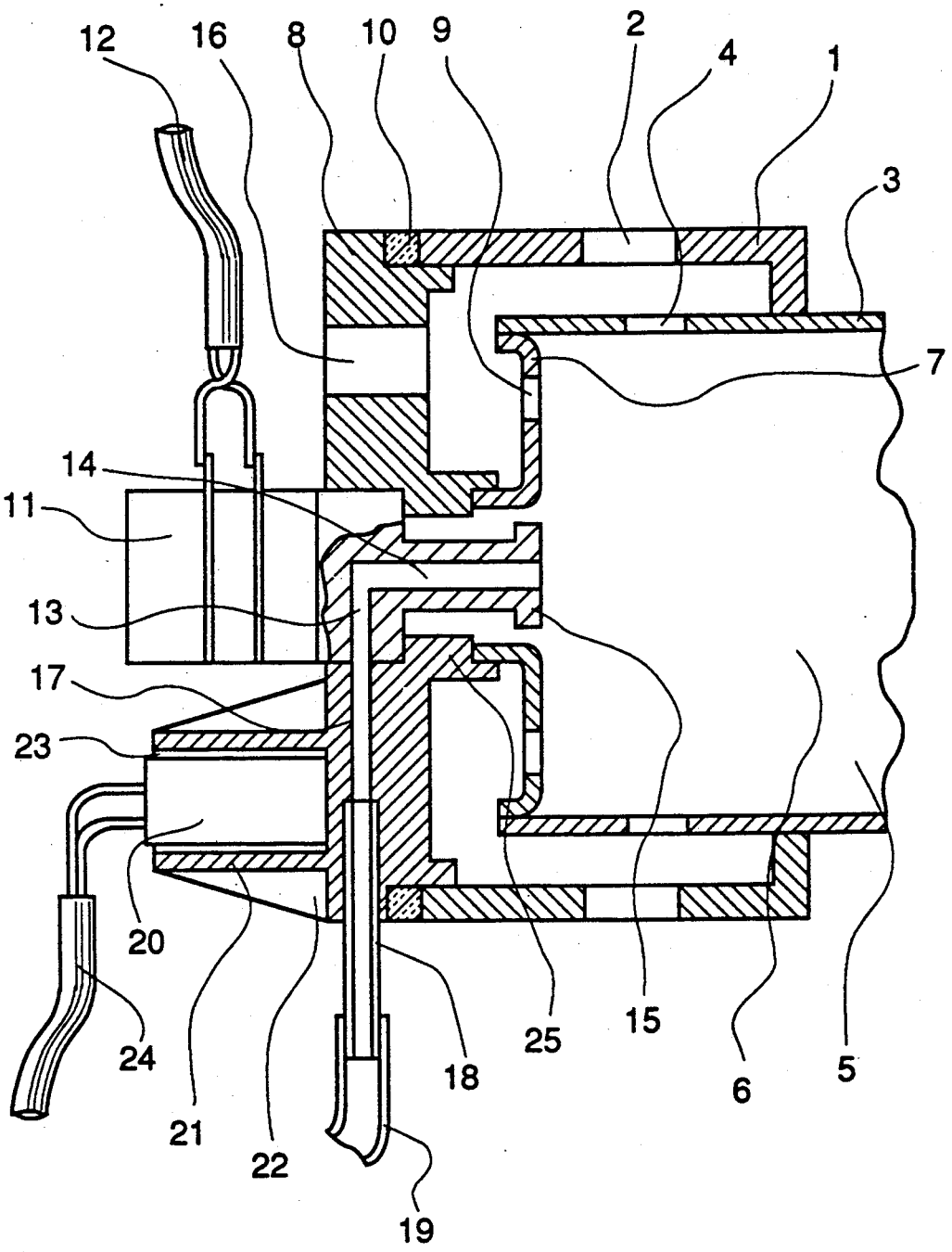
FIG. 1 is a sectional view of part of the heater with a heating element inserted in a projection.
Figure 3:
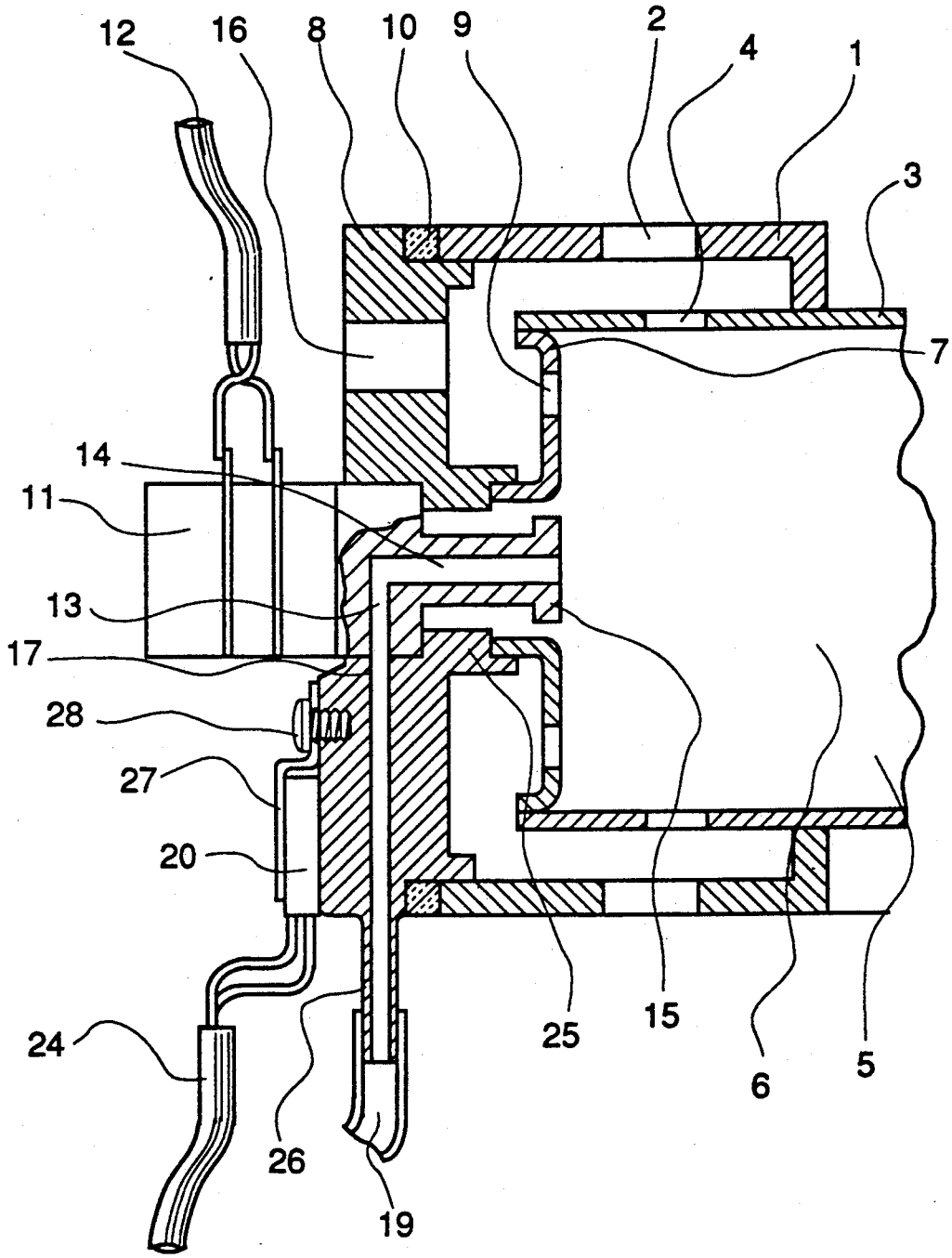
FIG. 3 is a sectional view analogous to FIG. 1, but with the heating element mounted.

Identical parts are designated by identical reference numerals in all figures. FIGS. 1 and 3 show longitudinal sections of part of a heater, in which an ultrasonic atomizer, a fuel supply line, and a heating element are arranged. Details, such as the fastening of the ultrasonic atomizer and the admission of the fuel into the atomizer, are not represented. These are analogous to what was disclosed in, e.g., U.S. Pat. No. 4,732,322 and West German patent No. 35,22,697.

The burner housing 1 is shown with passage openings 2 for supplying the combustion air to the combustion chamber wall 3. The combustion chamber wall 3 also has passage openings 4 for guiding the combustion air into the combustion space 5, in which the flame 6 is formed during operation. The front end of the combustion chamber wall 3 is closed off by the combustion chamber bottom 7 and is connected via the combustion chamber bottom 7 to the atomizer flange 8. The combustion chamber bottom 7 has passage openings 9 for admitting part of the combustion air into the combustion space 5. A gasket 10 made of a heat-insulating material, which acts as a heat choke, is arranged between the atomizer flange 8 and the burner housing 1. This thermal separation is primarily intended to prevent excessive transfer of the heat generated by the heating element 20 into the burner housing 1, which is still cold during the cold start phase and therefore acts as a massive heat sink, and intensive heat flow from the combustion chamber 3, which is 10 hot in the operating state, onto the atomizer flange 8, in order to avoid excessive heating of the fuel, because otherwise vapor bubbles would readily occur in the fuel supply line, which would lead to malfunction. In the simplest case, the gasket 10 is a ring consisting of a heat-insulating material, but it may also consist of a profile ring made of a solid material, e.g., ceramic. This design may also be inserted as a connection piece between the atomizer flange 8 and the combustion chamber housing 1, so that particularly good thermal separation of the two components is achieved.

Figure 2:
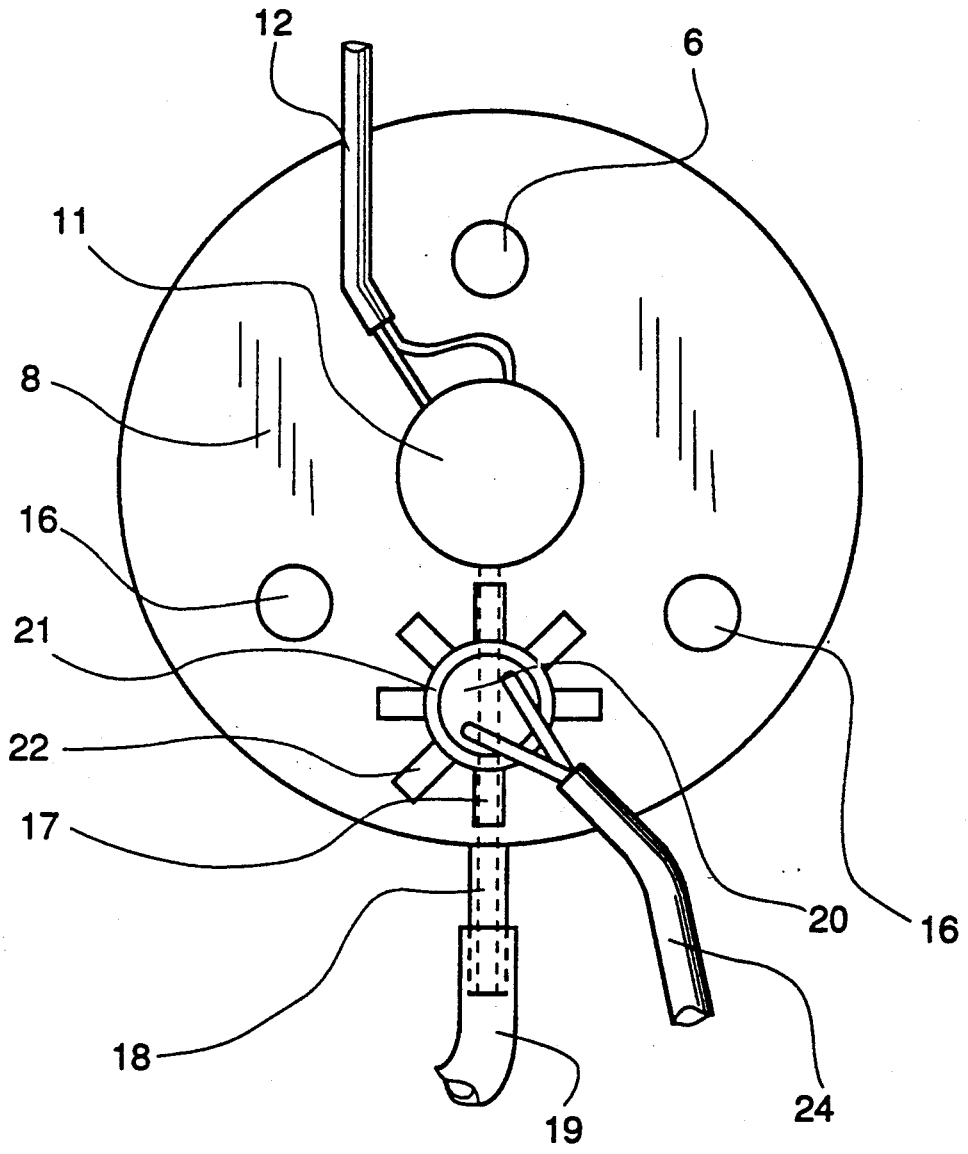
FIG. 2 is a top view of the device according to FIG. 1.

The atomizer flange 8 centrally carries the ultrasonic atomizer 11 with the electrical connections 12 to the ultrasound generator. The ultrasonic atomizer 11 has a radial bore 13 for fuel supply, which opens into an axial bore 14 via which the fuel is fed to the atomizer plate 15. The passage openings 16 in the atomizer flange 8 serve to feed combustion air to the combustion chamber 5. In the embodiment shown, fuel is fed to the axial bore 13 in the ultrasonic atomizer 11 via a canal 17 arranged in the atomizer flange 8, where a pipe section 18 for connecting the fuel feed line 19 is arranged at the inlet side of the canal. However, the fuel feed line 19 need not be led over the shortest way through the atomizer flange 8 to the axial bore 13 of the ultrasonic atomizer 11, but it may also be laid over a partial section or extended by loops or in a helical shape on the atomizer flange 8. In the case of the latter pattern of arrangement of the fuel feed line 19, better screening against the heat from the combustion chamber 5 is achieved, and the heat acceptance from the heating element 20 is also improved at the same time. The heating element 20, e.g., a resistance wire element or preferably a PTC element, is arranged in a socket-like receiving body 21 in the embodiment according to FIG. 1 and the corresponding FIG. 2. This the receiving body 21 has lateral support ribs 22, and in order to achieve good heat transfer from the heating element 20 to the atomizer flange 8, a gap 23 that may be formed is filled with a heat-conducting paste. To do so, this paste is applied as a thin layer to the heating element 20 prior to installation, after which the heating element is introduced into the socket 21. The electrical terminals 24 of the heating element 20 supply the operating voltage (ca. 12 V or 24 V) from the control device of the heater.

The atomizer flange 8 usually consists of a flat element with one or several passage openings 16 for combustion air and the receiving body 21 for the heating element 20. For holding the ultrasonic atomizer 11, it also has an integrally cast projection 25 which surrounds the opening for the ultrasonic atomizer 11 as a ring and serves to connect the combustion chamber bottom 7 in the section facing the combustion chamber 5. However, the atomizer flange 8 may also be formed by two or several webs, wherein the combustion air is able to pass through between the webs, and the receiving body 21 is arranged on one of the webs.

Figure 4:
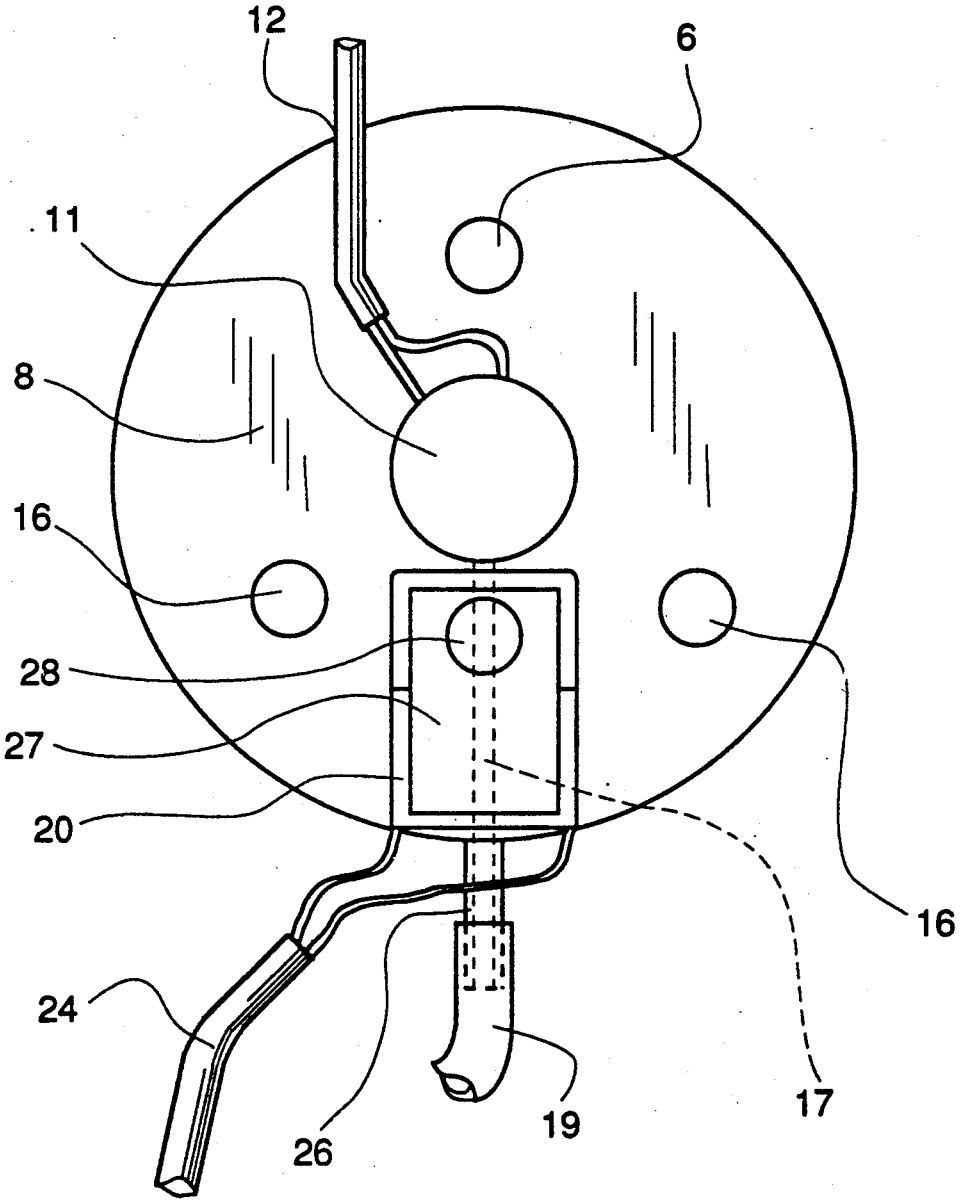
FIG. 4 is a top view of the device according to FIG. 2.

The same heater design is shown in the embodiment according to FIGS. 3 and 4. However, a socket 26 is provided on the atomizer flange 8 for connecting the fuel feed line 19. In this embodiment, the heating element 20 consists of a flat PTC element with the electrical terminal 24. This flat heating element 20 is located on the atomizer flange 8 and is held by a spring clip 27, which is fastened to the atomizer flange 8 with a screw 28 (or rivet), and is pressed onto the flange in order to ensure heat-conducting contact.

While a specific embodiment of the invention has been shown and described in detail to illustrate the application of the principles of the invention, it will be understood that the invention may be embodied otherwise without departing from such principles.

What is claimed is:

1. A heater for vehicles operating independently of a vehicle engine, comprising:

a burner housing, including burner housing walls and an open forward end;

an ultrasonic atomizer flange connected to said burner housing at said open forward end, said atomizer flange including a longitudinal through-bore and a radially extending canal connected to said through-bore;

a combustion chamber positioned within said burner housing, said combustion chamber including a combustion chamber sidewall positioned spaced from a sidewall of aid burner housing and a combustion chamber front-end wall;

an ultrasonic atomizer arranged in said atomizer flange in said longitudinal through-bore, said atomizer including an axial bore communicating with a combustion space within said combustion chamber, and a radial bore, connected to said axial bore, said radial bore being positioned communicating with said radial canal of said atomizer flange;

a fuel supply line connected to said radial canal of said atomizer flange for supplying fuel to said radial canal, said fuel passing through said radial canal, passing through said atomizer radial bore and passing through said atomizer axial bore for delivery of fuel to said combustion chamber space;

and, a heating element connected to said atomizer flange positioned outside said fuel feedline adjacent said atomizer, said heating element having a heated surface in contact with said atomizer flange, adjacent said radial canal, for heating said atomizer flange for direct heat transfer between said atomizer flange and fuel in said radial canal.

2. A device according to claim 1, wherein said heating element is positioned in heat-conducting connection with said atomizer flange on a side facing away from said combustion chamber.

3. A device according to claim 1, wherein said heating element is formed as a semiconductor element connected to a heater control device.

4. A device according to claim 3, wherein said semiconductor element is a PTC element.

5. A device according to claim 1, wherein a heat insulation element is arranged between said atomizer flange, carrying said heating element and receiving said fuel supply line, and said burner housing.

6. A device according to claim 5, wherein said heat insulation is formed by an angular ceramic ring.

7. A device according to claim 6, wherein said angular ceramic ring includes a threaded section for connection to the atomizer flange and another threaded section for connection to the burner housing.

8. A device according to claim 1, wherein said heating element is arranged in a socket-like receiving body, said receiving body being cast integrally on the atomizer flange.

9. A device according to claim 1, wherein said heating element is arranged positioned flat on the atomizer flange it is held with a spring clip.

10. A heater according to claim 1, wherein a gasket formed of heat-insulating material is positioned between said atomizer flange and said burner housing walls to restrict heat transfer between said atomizer flange and said combustion chamber walls.

11. A heater according to claim 1, wherein said atomizer flange is formed as an integral element.

12. A heater according to claim 1, wherein said combustion chamber front end walls are connected to an extension of said atomizer flange surrounding said atomizer axial passage, positioning said combustion chamber front end wall spaced from said atomizer flange.

13. A burner according to claim 1, wherein said atomizer flange includes air passage through holes, said combustion chamber wall includes air passage through holes and each of said combustion chamber wall and said combustion chamber front end wall include air passage through holes, an air passage formed in a space defined on one side by said atomizer flange and said burner housing walls and defined on another side by said combustion chamber wall and said combustion chamber front end wall.

14. A heater for vehicles operating independently of a vehicle engine, comprising:

a burner housing, including burner housing walls and an open forward end;

an integrally formed ultrasonic atomizer flange connected to said burner housing at said open forward end, said atomizer flange including a longitudinal through-bore and a radially extending canal connected to said through-bore;

a combustion chamber positioned within said burner housing, said combustion chamber including a combustion chamber sidewall positioned spaced from a sidewall of said burner housing and a combustion chamber front-end wall with a wall face spaced from said atomizer flange;

an ultrasonic atomizer arranged in said atomizer flange in said longitudinal through-bore, said atomizer including an axial bore communicating with a combustion space within said combustion chamber, and a radial bore, connected to said axial bore, said radial bore being positioned communicating with said radial canal of said atomizer flange;

a fuel supply line connected to said radial canal of said atomizer flange for supplying fuel to said radial canal, said fuel passing through said radial canal, passing through said atomizer radial bore and passing through said atomizer axial bore for delivery of fuel to said combustion chamber space;

and, a heating element connected to said atomizer flange positioned outside said fuel feedline adjacent said atomizer, said heating element having a heated surface in contact with said atomizer flange, adjacent said radial canal, for heating said atomizer flange for direct heat transfer between said atomizer flange and fuel in said radial canal, said atomizer flange including air passage through holes, said combustion chamber wall including air passage through holes and each of said combustion chamber wall and said combustion chamber front end wall including air passage through holes, an air passage formed in a space defined on one side by said atomizer flange and said burner housing walls and defined on another side by said combustion chamber wall and said combustion chamber front end wall.

* * * * *